US008708723B2

(12) United States Patent
Stoltz et al.

(10) Patent No.: US 8,708,723 B2
(45) Date of Patent: Apr. 29, 2014

(54) ELECTRICAL CONNECTION BETWEEN CONDUCTIVE ELEMENTS

(75) Inventors: Bruno Stoltz, Ruelsheim (DE); Jochen Endress, Altlusheim (DE); Michael Theilig, Schwetzingen (DE); Matthias Heinzmann, Brombach (DE)

(73) Assignee: Pfaudler-Werke GmbH, Schwetzingen (DE)

( * ) Notice: Subject to any disclaimer, the term of this patent is extended or adjusted under 35 U.S.C. 154(b) by 124 days.

(21) Appl. No.: 13/393,433

(22) PCT Filed: Apr. 8, 2010

(86) PCT No.: PCT/EP2010/054654

§ 371 (c)(1),
(2), (4) Date: Jun. 11, 2012

(87) PCT Pub. No.: WO2011/023422

PCT Pub. Date: Mar. 3, 2011

(65) Prior Publication Data

US 2012/0241215 A1 Sep. 27, 2012

(30) Foreign Application Priority Data

Aug. 31, 2009 (EP) ..... 09169068

(51) Int. Cl.
*H01R 9/24* (2006.01)

(52) U.S. Cl.
USPC ..... 439/178; 439/86; 439/931; 29/845

(58) Field of Classification Search
USPC ..... 439/178, 86, 931, 179, 886; 29/845
See application file for complete search history.

(56) References Cited

U.S. PATENT DOCUMENTS

| | | | | | |
|---|---|---|---|---|---|
| 4,152,540 | A | * | 5/1979 | Duncan et al. | 174/152 GM |
| 4,964,788 | A | * | 10/1990 | Itameri-Kinter et al. | 417/422 |
| 4,984,927 | A | * | 1/1991 | Kojima et al. | 403/30 |
| 4,984,973 | A | * | 1/1991 | Itameri-Kinter et al. | 417/422 |
| 5,006,286 | A | | 4/1991 | Dery | |
| 5,318,756 | A | * | 6/1994 | Sheller et al. | 422/174 |
| 2002/0046865 | A1 | | 4/2002 | Bertini | |

FOREIGN PATENT DOCUMENTS

| | | | |
|---|---|---|---|
| EP | 0189992 | A2 | 8/1986 |
| EP | 1206009 | A2 | 5/2002 |
| EP | 1346764 | A1 | 9/2003 |
| WO | 2007046635 | A1 | 4/2007 |

* cited by examiner

*Primary Examiner* — Gary Paumen
(74) *Attorney, Agent, or Firm* — Michael L. Dunn

(57) ABSTRACT

A method of forming an electrically conductive connection between two or more electrically conductive elements (2, 6) is provided, as is the resulting connection. Wherein the two or more electrically conductive elements (2, 6) are coated with a non-conductive coating (7), wherein an at least partially electrically conductive pasty medium (8) is located in a region (12) between the electrically conductive elements (2, 6) at regions of the electrically conductive elements (2, 6) which are substantially free from any non-conductive coating (7). The method comprising positioning one or more sealing elements (20) such that they completely isolate the partially electrically conductive pasty medium (8), such that after the electrically conductive elements (2, 6) are connected together, the sealing element (20) is held, and preferably compressed, between the electrically conductive elements (2, 6) and form a seal separating the at least partially electrically conductive pasty medium (8) from the surrounding environment.

21 Claims, 10 Drawing Sheets

ELECTRICAL CONNECTION BETWEEN CONDUCTIVE ELEMENTS

CROSS-REFERENCE TO RELATED APPLICATIONS

The present application is the U.S. national stage application pursuant to 35 U.S.C. §371 of International Application No. PCT/EP2010/054654, filed Apr. 8, 2010, which application claims benefit of European Application No. EP09169068.5, filed Aug. 31, 2009.

BACKGROUND OF THE INVENTION

The present invention relates to a method of producing an electrically conductive connection between metallic components which have a non-conductive coating. In particular, the invention relates to a method of producing an electrically conductive coating between metallic components which are coated with an enamel, glass or similar coating that is resistant to corrosive media.

In the chemical and pharmaceutical industries, it is common for agitators to be used in corrosive environments. In such cases, the agitator blades and the agitator shaft to which the blades are connected are usually coated with materials such as enamel or glass, which are stable in such environments and can withstand attack by such media. It is normal for both the agitator shaft and the agitator blades to be completely coated by the stable medium so that they only contact one another by way of the medium, which typically is not electrically conductive.

EP0189992 describes an agitator assembly wherein the exterior surfaces of agitator blades as well as the exterior surface of a drive shaft for the agitator blades are coated with glass and a hub of the agitator blade assembly is interference fitted to the drive shaft in glass-to-glass surface contact sufficient to withstand torque imparted to the blades by the drive shaft. The shrink-fitting of agitator blades to a drive shaft in this way has been shown to be impermeable to liquids and is therefore liquid-tight, it having been verified that liquid particles penetrate the joint only to a small extent in a region at the periphery of blade hub/drive shaft connection area.

However, it will be appreciated that in such an assembly there is no electrical connection between the agitator blades and the drive shaft. The lack of any electrical connection between the agitator blades and the drive shaft means that the agitator cannot be electrically earthed. Regulations now require that within certain vessels used in chemical and pharmaceutical processes all components must be grounded to prevent electrostatic charges building up.

Also, the lack of any electrical connection between the agitator blades and the drive shaft means that known methods of monitoring the state of the enamel coating the blades cannot be used. In such a method, electrical means for detecting damage would be connected between an electrode extending into, for example, a conductive liquid contained in the vessel and an external conductor connected to the drive shaft. When enamel damage occurs, the conductive liquid would come into direct contact with the metal of the agitator blades, thus closing the electrical circuit to actuate an alarm. If an electrical connection is required currently it is necessary to provide metallic rings around the blade hub which can contact a metallic area of the agitator shaft, both of which metallic areas must be made from chemically stable material. These rings are typically made from corrosion-resistant steel and are welded in the interior of a blade hub and the shaft of an agitator assembly. It is critical, however, that the rings are sealed with respect to the adjoining enamel coating to prevent corrosive attack on the underlying metal. This is a potential source of damage to the enamel coating. As a result of these requirements and the fact that only chemically stable metals can be used, this method is very costly. Also, it is not possible to upgrade an existing agitator assembly to apply it. In an alternative approach, chemically stable screws, wires and cables can be used to conjoin components together but this in itself can be a cause of considerable damage to the enamel or other non-conductive coating. Also, both of these methods can lead to a high contact resistance existing between the two components which is not always desirable.

EP 1346764 details a mechanism of utilizing an electrically conductive paste between the two insulated items, to overcome the above problems. In particular, the pasty material is aligned with small breaks in the insulating film on the electrical conductive and insulated items, so as to provide the electrical connection there-between. This technique works especially well with interference fit connections, as these connections are generally watertight, and thus protect the pasty material from the surrounding environment.

It is desirable, however, to improve on this prior technique by allowing the use of the conductive pasty medium without the requirement of locating this within a water or airtight seal. For example, it is not always practicable to provide a fully isolating interference fit seal, which is a requirement for the above design. The present application overcomes this drawback, by allowing the use of a conductive pasty material without the use of a specifically isolating connection between the conductive and isolated items.

BRIEF SUMMARY OF THE INVENTION

A first aspect of the present disclosure relates to a method of electrically connecting two or more conductive elements. In particular, these conductive elements are provided with a non-conductive coating over most, if not all, of their outer surface. Clearly, if the outer surface is provided with a non-conductive coating, simple connection together of the conductive elements will not lead to an appropriate electrical path there-between. The method of creating the connection may further comprise introducing a conductive, or partly conductive paste lying in a region between the conductive elements, and in particular lying at places on the conductive element where the non-conductive coating has been removed or was never present. In this manner, it is clear that an electrical connection can be formed via the conductive paste through the gaps in the non-conductive coating so as to electrically connect together the conductive elements.

It is further possible to provide a sealing element, which is preferably airtight and/or watertight, in a region near the conductive paste in order to isolate this from the surrounding environment of the conductive elements. In particular, this sealing element can be placed such that when the two conductive elements are connected together in some manner, the sealing element forms a bridge between these two conductive elements and leads to an appropriate seal isolating the conductive paste from the environment surrounding the conductive elements. It is further advantageous if the seal is to degree compressed between the two conductive elements, thus ensuring that no leakage gaps can form across the seal.

As well as describing the method for producing this contact, the present disclosure also relates to the actual contact itself between a plurality of electrically conductive elements. Obviously, the methods described will also lead to a product which is considered as part of the present disclosure.

The sealing element may either be fabricated as an integral part of one, or more, of the electrically conductive elements. For example, when the conductive element is manufactured, the region in which the conductive paste will be placed is known, and thus the sealing element can be integrated with the conductive element around this point. It is also possible that during the connection together of the electrically conductive elements, an appropriate sealing element is introduced at the point of connection, so as to appropriately isolate the pasty material. In this case, it is clear that the present disclosure may also relate to only a single conductive element in which the appropriate sealing element has been combined. Whilst the present disclosure generally relates to the formation of an electrical connection between more conductive elements, it is clear that the present disclosure could also relate to just a single conductive element which is also adapted to incorporate the sealing element in a region so as to isolate a conductive paste which could be used in an electrical connection.

The sealing element itself can take on a variety of forms, and further can be comprised of a variety of materials. Any appropriate material which will withstand the environment surrounding the electrical connection is appropriate, in particular if this material is chemically inert and will not react with the surrounding environment. Example materials include a range of rubbers or synthetic plastics, such as PTFE, which have the further advantage of being slightly compressible such that a compression between the two electrical elements will lead to a slight compression of the seal and thus an improved isolation of the conductive paste. This is particularly useful if the way of connecting the conductive elements is by a shrink-fit connection.

If one of the elements is intended to frictionally engage with the second or more elements, this can be achieved by cooling one of the elements to reduce its size slightly to allow it to be positioned within an appropriate holding portion of the other elements. Once the cooled element starts to heat up it will naturally expand to its original size, and thus can be frictionally held within the other electrically conductive elements. Clearly, if the mechanism of fixing together the conductive elements is by this shrink-fitting technique, the sealing element will be brought under a compression force between the one or more elements, thus compressing the sealing element and leading to a good isolation seal.

It is possible for the pasty medium to be held in a pocket formed on one or more of the electrically conductive elements. In particular, the pasty medium can be placed in a pocket which is formed in the region of the hole in the insulating outer material, so as to make a good electrical connection with the conductive element beneath. A variety of mechanisms for isolating this pasty material by means of the seal exist, one of which relates to completely surrounding the pasty material by means of the seal on the surface of the conductive element. If the seal is placed completely surrounding the pasty material on the surface of the conductive element, it is clear that when the conductive elements are brought into connection, the seal will be formed and completely isolate the pasty material from the surrounding environment.

An additional technique for isolating the conductive paste would be to provide a plurality of seals surrounding areas or elements or parts of at least one of the conductive elements. The regions chosen for such sealing elements will be such that after connection of the conductive elements together, the seals would again form a region completely surrounding the volume in which the conductive paste is present. For example, if the element comprising the seals is of a cylindrical form, two circular seals could be placed either side of the area holding the pasty material, such that after engagement with the remaining conductive elements, the two seals form a tubular region comprising the pasty material which is fully isolated from the surrounding. It will be clear to the skilled person that any number of such seals can be provided depending upon the geometry of the connection between the conductive elements.

In addition, or instead of, providing the sealing element, it is also possible to provide a channel leading to the volume holding the conductive paste. Such a channel would extend through one or more of the conductive elements from the outside of the element through to the volume holding the conductive paste. Such a channel could be used for a variety of techniques, for example: allowing additional conductive paste to be positioned within the connection point. Additionally, if the connection point were originally provided without the conductive paste, the channel would allow the opportunity of injecting or positioning conductive paste within the conductive region, so as to form the electrical conduction. Further, if the conductive paste were originally dosed in the region leading to the connection, and after assembly of the conductive elements was found to be too little, the channel could be used to introduce more conductive paste.

As will also be clear, it is possible to use a channel, if provided, to actually remove the conductive paste from the conductive region. If the conductive elements have been shrink-fit together and the elements are to be disengaged from each other, removal of the conductive paste can improve the disassembly process. This could readily be achieved by use of an appropriate solvent and some sort of syringe, in order to dose the solvent through the channel into the region comprising the conductive paste.

Further, the channel could be used to ensure that the regions on the conductive elements without the insulation coating were appropriately aligned. The channel would allow a viewing port through to this region which could be used in order to ensure that the two conductive regions are appropriately aligned prior to incorporation of the conductive paste. Further, if the channel is used in conjunction with the sealing element, the channel could be used to check that the seal is indeed air and/or watertight. By introducing air or water of a high pressure into the channel, it will be obvious whether the seal is indeed appropriately sealing the area around the electrical connection between the conductive elements.

It is further possible to provide this channel open ended, or also to provide some mechanism of sealing the channel from the outside. Any number of sealing mechanisms will be apparent, not least of all a screw or compression-fit bung element, or the like. Indeed, any appropriate mechanism for fully sealing the end of the channel can be conceived.

Additional discussion is presented relating to the possibility of providing elongate electrical connections passing through the non-conductive coatings on the electrically conductive elements. These elongate structures can be used to improve the overlap of the connections during attachment of the conductive elements together. Markings may also be provided which show the location of the grooves, in order to improve the ease of connection.

BRIEF DESCRIPTION OF THE SEVERAL VIEWS OF THE DRAWINGS

The nature and mode of operation of the present invention will now be more fully described in the following detailed description of the invention taken with the accompanying drawing figures, in which.

DETAILED DESCRIPTION OF THE INVENTION

In the following, the concepts of the disclosure are described with relation to an agitator assembly 1. This is, of course, by way of example only. Indeed, the following methods and products can, as will be appreciated by the skilled person, readily be applied to any connection between two or more electrically conductive items which have an insulation coating thereon.

Figure 1:
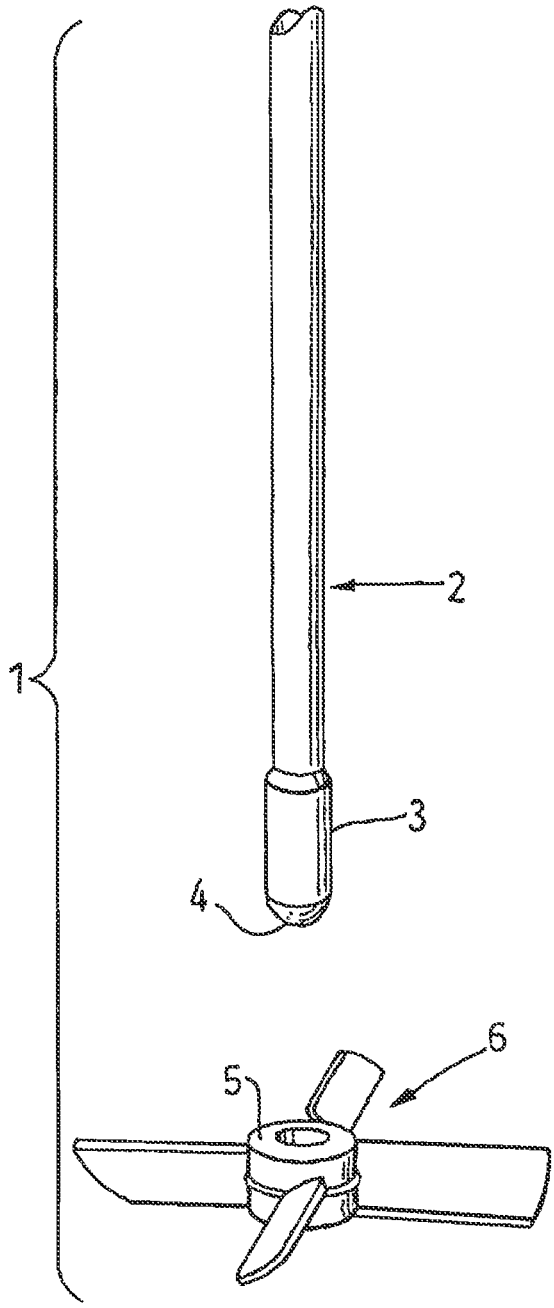
FIG. 1 is a perspective view of a prior art agitator assembly prior to the shrink-fitment of an agitator blade assembly to a drive shaft.
Figure 2:
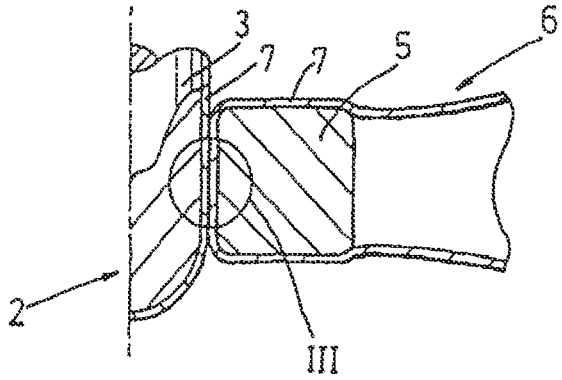
FIG. 2 is a cross-sectional view to an enlarged scale, through an agitator blade assembly and drive shaft as shown in FIG. 1 when connected together by a shrink-fit connection.
Figure 3:
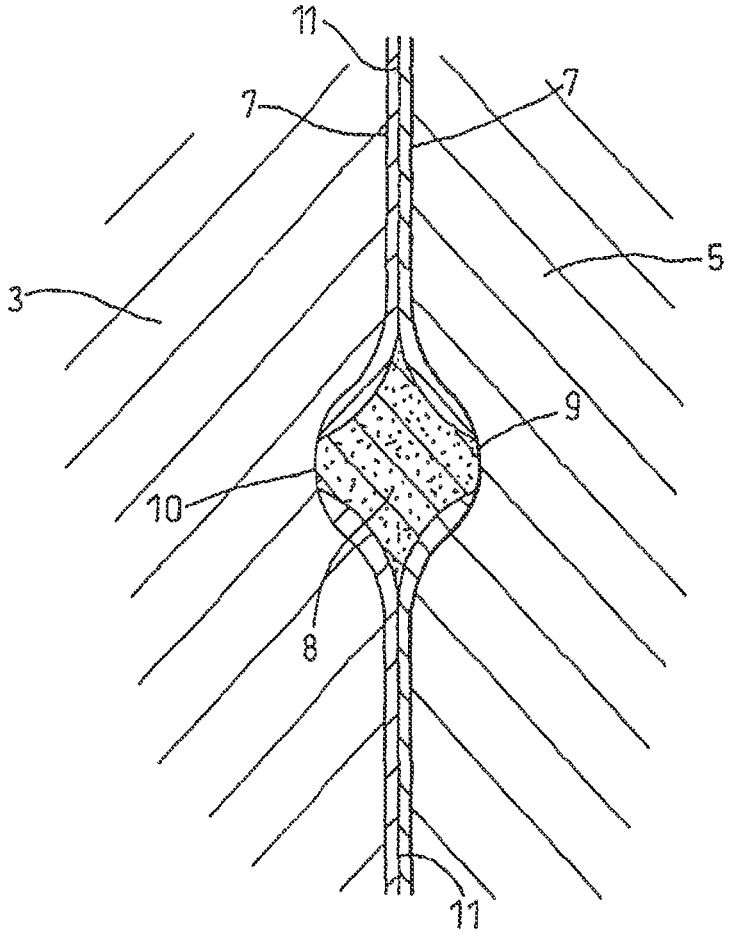
FIG. 3 is a view to a considerably increased scale of the ringed area marked III in FIG. 2 and showing a method of connection related to the present invention.

With reference to FIG. 1, an agitator assembly 1 comprises a drive shaft 2 with an enlarged end section 3 and closed end 4 for fitment into a hub 5 of an agitator blade assembly 6. As shown in FIG. 2, the whole of the exterior surfaces of the drive shaft 2 and the agitator blade assembly 6 are coated with a layer of enamel or glass 7, the glass being bonded thereto by conventional practice well known to those with skill in the art. The agitator assembly is then assembled by the shrink-fitment of the agitator blade assembly 6 to the enlarged end section 3 of the drive shaft, again in accordance with conventional practice. Hence, as indicated in FIG. 2, there exists two electrically non-conductive enamel or glass layers 7 between the agitator blade assembly 6 and the drive shaft 2 so that the latter are not in electrical contact with one another.

In part accordance with the present invention, in order to ensure that the agitator blade assembly 6 and the drive shaft 2 are placed in electrical contact, an electrically conductive pasty medium 8 may be located in a region between the assembly 6 and the drive shaft 2 in contact with portions 9 and 10 respectively of the assembly 6 and the drive shaft 2, which are substantially free of the enamel or glass coating 7.

The pasty medium 8 may be located away from the edges of the shrink-fit connection and well within the area of contact between the assembly 6 and the drive shaft 2, surrounded by interference fitted contact areas 11 between these components. To a first order, these interference fitted contact areas 11 prevent the pasty medium 8 being washed out of, or otherwise accidentally removed from, the agitator assembly when it is in use. The shrink-fit connection itself thereby provides a primary protection for the pasty medium 8.

As it is necessary to for the pasty medium 8 to be in electrical contact with the underlying metal of the assembly 6 and the drive shaft 2, the two components 2, 6 are either ground prior to their shrink-fitment to remove the enamel or glass coating 7 in areas which will lie apposed to one another when they have been shrink-fitted together, or they are treated to ensure that the appropriate portions 9 and 10 comprise blank metal that has been left free of the non-conductive coating 7. In the latter case, it may be necessary to remove scale to produce bare metal portions 9 and 10 that will ensure a good electrical connection. In addition, preferably at least one of the two components 2, 6, and advantageously both of them, is ground or otherwise treated to provide a pocket 12 in which the bare metallic portion 9 or 10 that is substantially free of the non-conductive coating 7 is formed and in which a volume of the pasty medium 8 can be retained.

Preferably, the surface area of the pocket 12 is large in comparison to the surface area of the metallic portion 9 or 10 located therein. Also, the surface area of the pocket opening in one component as presented to the other component should also be large in comparison to the surface area of the metallic portion 9 or 10 of that other component. In this way, the bare metallic portions 9 and 10 can be located well away from the periphery of the shrink-fitted joint and therefore protected from any external media which may penetrate the joint during use of the assembly.

Figure 5:
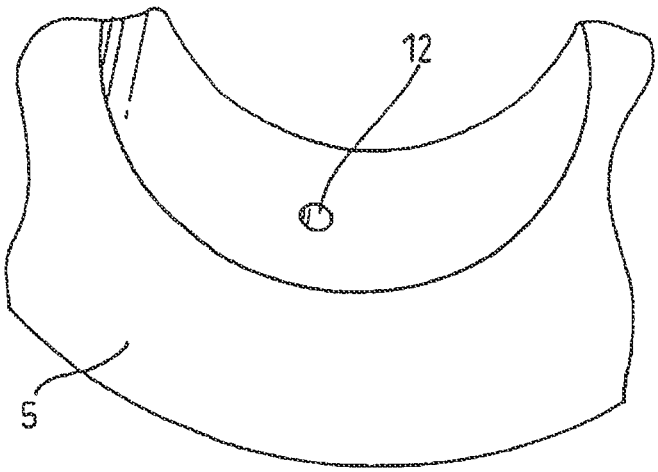
FIG. 5 is a perspective view of the interior of an agitator blade hub modified for fitment to the drive shaft shown in FIG. 6.
Figure 6:
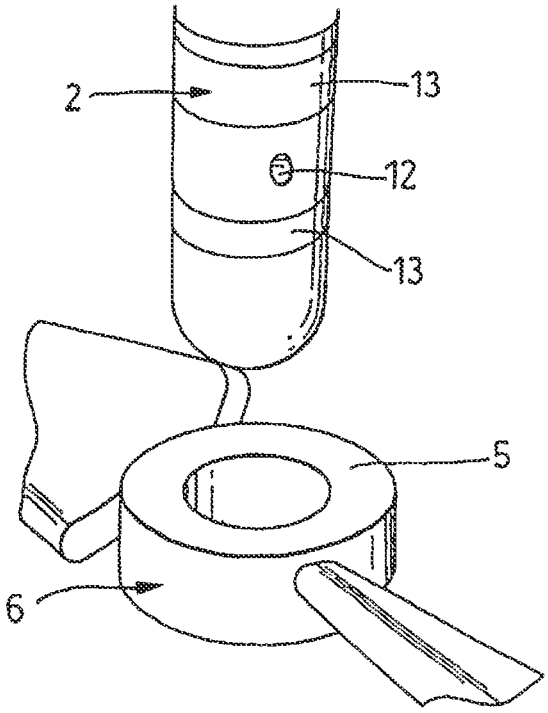
FIG. 6 is a view similar to FIG. 1 but showing a modified drive shaft.

The pocket, or pockets, 12 are possibly circular with a diameter of approximately 5-6 mm. The pocket 12 in the blade assembly 6 is located centrally of the hub 5 and that in the drive shaft 2 is located in a region 2 which will lie adjacent thereto when the assembly 6 has been shrink-fitted onto the drive shaft 2, as shown in FIGS. 5 and 6. Preferably, as shown in FIGS. 4 and 6 the drive shaft 2 is marked by bands or upraised portions 13 between which the hub 5 is fitted in order to ensure an optimal overlapping of the pockets 12.

Once the pockets 12 have been ground out, they can be both completely filled with the pasty medium and the surfaces of the medium smoothed to stand lightly proud of the adjacent surfaces of the hub 5 and the drive shaft 2. The two components can then be shrink-fitted in a conventional manner. Other methods or filling the pockets 12 are presented below.

Figure 4:
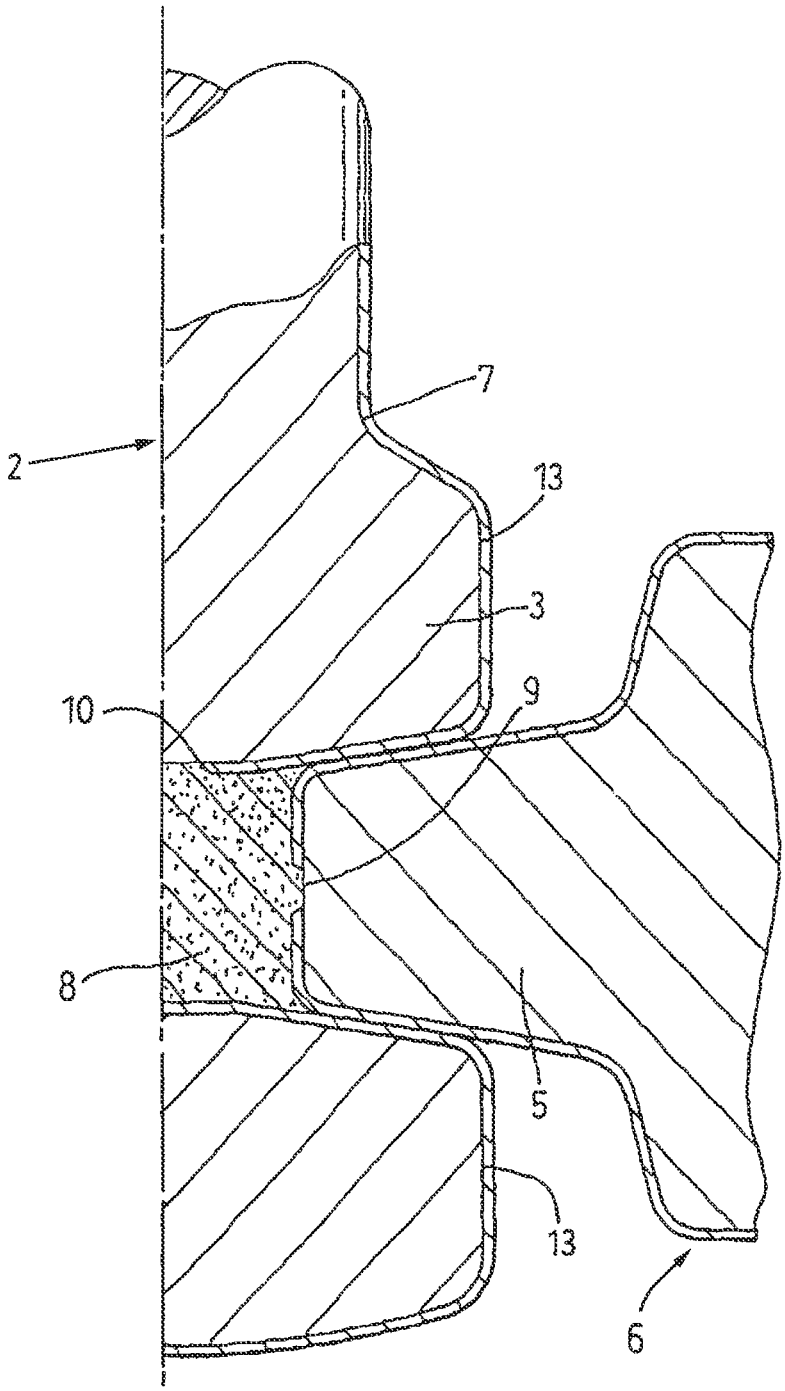
FIG. 4 is a view similar to that of FIG. 2, but to an increased scale, and showing a variation in the method of connection in accordance with FIG. 3.

FIG. 4 also shows how a pocket 12 in a component such as a drive shaft 2 can be made by providing around the shaft 2 a deep enameled part-conical groove, part of the base of which is either left free from enamel or has had the enamel removed therefrom to provide the bare metallic portion 10. The bottom of the groove is then completely filled with the pasty medium 8 prior to the shrink-fitting of the blade assembly 6 thereto in the region between the bands 13. In this way, during use of the agitator assembly, a corrosive medium being mixed by the assembly cannot penetrate sufficiently into the shrink-fitted joint to reach the bare metallic areas 9 and 10 because the pasty medium prevents this from occurring.

Also, it is often the case in use of an agitator assembly such as is shown in FIG. 4 that the mixing container in which the assembly is located is subject to a positive or negative pressure (vacuum). As the shrink-fitted joint is not pressure-tight, the medium being mixed often penetrates the joint and collects as undesired residues at the bottom of the groove in the shaft 2. However, the presence of the pasty medium 8 at the bottom of the groove in the present invention effectively prevents penetration of the medium being mixed any distance into the joint. Thus, the presence of the pasty medium 8 at the base of the joint is advantageous regardless of its electrically conductive properties.

The pasty medium 8 itself is at least partially electrically conductive and preferably comprises a chemically universal non-corroding material, in order that any material which penetrates into the connection joint does not cause any corrosion to occur that may destroy the joint. Also, it is important, that the medium 8 itself does not damage the regions of the drive shaft 2 and the blade assembly 6 with which it is in contact In appropriate cases it can be made from one or more food grade materials.

Preferably, the pasty medium comprises a mixture of including graphite, the ratio of graphite to the other materials of the medium being varied to achieve the desired conductivity. Other materials, such as fillers, may be added to the medium, as desired or required. For example it may comprise proprietary materials for identification purposes.

It will be appreciated that in order to ensure that cavities are not formed in the medium 8 during use of the agitator assembly, the medium 8 preferably has a coefficient of thermal expansion which is comparable with that of the components between which it is to be located. In most cases these components will be steel. Also, the medium 8 preferably has a viscosity which remains substantially constant over a temperature range between −90° C. and 300° C. inclusive. To facilitate use of the medium 8, preferably it is also made with sufficient form stability to be plastically deformable and impermeable.

It will be appreciated that the method described above provides an electrical connection between the components which has sufficient conductivity and which is simple and cost effective. There is no requirement for any external conductive connection between the components and the connection used is chemically stable.

Figure 7:
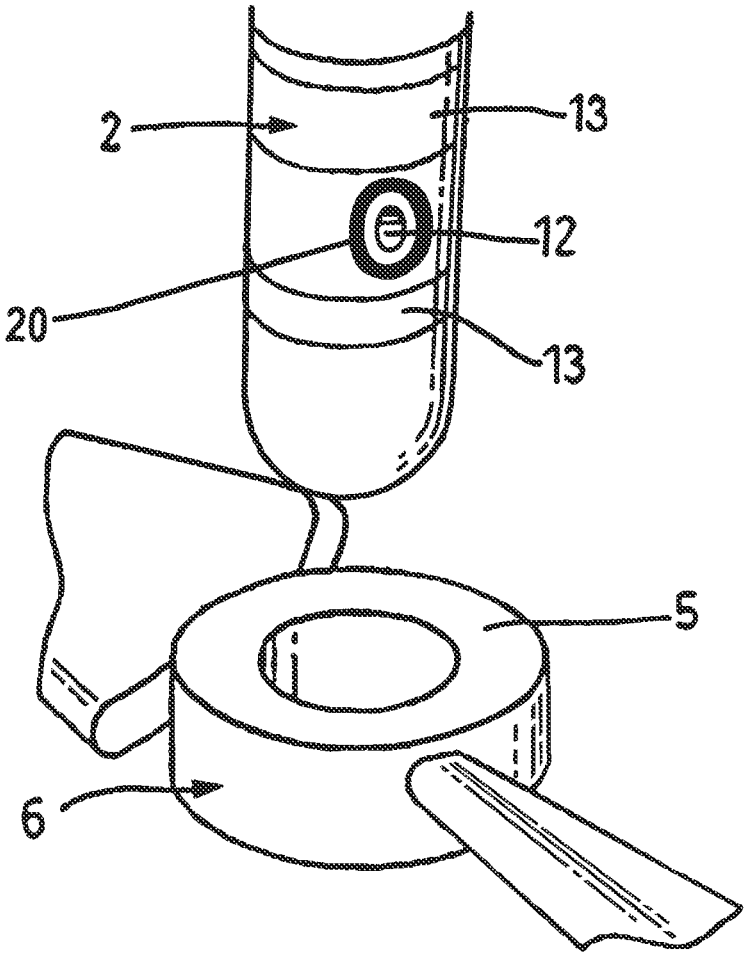
FIG. 7 is similar to that of FIG. 6, showing the incorporation of a further seal element.

As can be seen in FIG. 7, it is possible to modify the connection between the drive shaft 2 and the agitator 6. FIG. 7 is very similar to FIG. 6, but comprises an additional sealing element 20 which surrounds the pocket 12. As has been described above, the interference fit between the drive shaft 2 and the agitator 6 can provide a full watertight seal stopping any material which is being mixed by the agitator from reaching the electrically conductive pasty medium 8. In order to add a second level of protection to the pasty medium 8 from the material being mixed, it is possible to provide a further seal 20, which is preferably water and/or airtight. Whilst in the following the seal 20 will often be described as watertight, this is by way of example only, and it will be clear that the seal 20 could also be airtight. Also, if the joint being connected together is not an interference, or shrink fit, joint, the techniques as described below will allow for a seal 20, even when one is not readily obtained from the connection together of the electrically conductive elements.

It is by example only that the watertight seal 20 is provided on the enlarged end section 3 of the drive shaft 2. It is equally possible to provide the watertight seal 20 around the packet 12 provided in the hub 5, which would lead to a similar modification to the hub 5 shown in FIG. 5. The seal 20 shown in FIG. 7 is given purely by way of example. As can be seen in FIG. 7, the seal 20 may completely surround the pocket 12 so as to completely surround the pasty medium 8 when this is held in the pocket 12.

As will be clear, when the drive shaft 2 and agitator 6 are appropriately aligned such that both pockets 12 on each item are aligned to give the electrical connection, the watertight seal element 20 will surround the entire connection point. In other words, the watertight seal 20 will be present in the gap or region between the two abutting pieces, and will fully surround both pockets and the pasty material 8. Choice of an appropriate sealing material, will thus lead to a full watertight seal totally surrounding electric connection between the drive shaft 2 and agitator 6. One possible option for the sealing element 20 is to provide this by a thin PTFE film which appropriately surrounds the point of connection. The use of PTFE is ideal, as this tends to be a chemically inactive material which will be resilient to most if not all of the chemicals likely to be in contact with the agitator assembly 1. Naturally, any other material which provides the appropriate chemically inert nature for an appropriate material being stirred could be used in place of PTFE. Advantageously, this seal 20 would then be a film-like element, as this essentially ensures that at least in the region around the electric connection point the agitator 6 and drive shaft 2 are fully sealed together, thus protecting the pasty medium 8.

As is typical, and as has been described above, the agitator blade assembly 6 is often shrink-fitted to the drive shaft 2. The use of the above sealing element 20 is ideal, as this can be placed at the appropriate point around the pocket 12 prior to the shrink-fitting of the two pieces together. A typical shrink-fitting process would be to treat the shaft 2 in a cold fluid, for example liquid nitrogen, such that this would shrink by the appropriate amount. This can then be position within the agitator blade assembly 6, and allowed to expand again by exposure to normal temperature. If the sealing element 20 is provided at the appropriate region around the pockets 12, the expansion of the drive shaft 2 within the interior of the hub 5 of the agitator blade assembly 6 will lead to compression of the film making up the sealing element 20, and will consequently lead to a good seal by means of the compression between the drive shaft 2 and hub 5.

It is possible to structure the sealing element 20 as either an integral part of the drive shaft 2 or agitator assembly 6, for example integrated upon manufacture of these two parts; or to provide this after production of the two parts. For example, the sealing element 20 could be provided by an appropriate O-ring or whatever shape proved to be relevant for appropriately covering and surrounding the two pockets 12, which can be attached to the relevant part after it has been manufactured. That is, the sealing element could be provided with a sticky side which could be used to affix the sealing element around the relevant pocket 12. Additionally, it could be possible to ensure that the sealing element was positioned without the use of glue or otherwise around the pocket 12, such that after expansion of the drive shaft 2 the sealing element 20 is held in its appropriate position around the pocket 12.

Whilst FIG. 7 shows the use of a small circular element for the sealing element 20 surrounding the pocket 12, it is clear that any shape or configuration of the sealing element 20 would be appropriate. One key aspect is that in such a configuration a complete loop of whatever shape is provided around a pocket 12. A different configuration for the sealing element is also possible, wherein this is provided by two sealing elements 20 which will lead to the region surrounding the pocket 12 being sealed the material surrounding the agitator assembly 1. In this case, it could be that the two rings highlighted in FIG. 6 by reference numeral 13 could in fact be two sealing elements 20 rather than the bands 13 described in conjunction with the FIG. 6. That is, two sealing elements similar to O-rings could be provided around the entire circumference of the drive shaft 2 either side of the pocket 12, such that upon shrink-fitting of the agitator assembly 1 together, the two sealing elements 20 would be pressed within the interior of the hub 5, thus providing an appropriate seal. This could be a more advantageous design, in particular if the seal 20 were to be very small or on a very small diameter drive shaft 2. Clearly, instead of providing the two circumferential sealing elements to the drive shaft 2, these could equally be incorporated within the inner region of hub 5.

Figure 8:
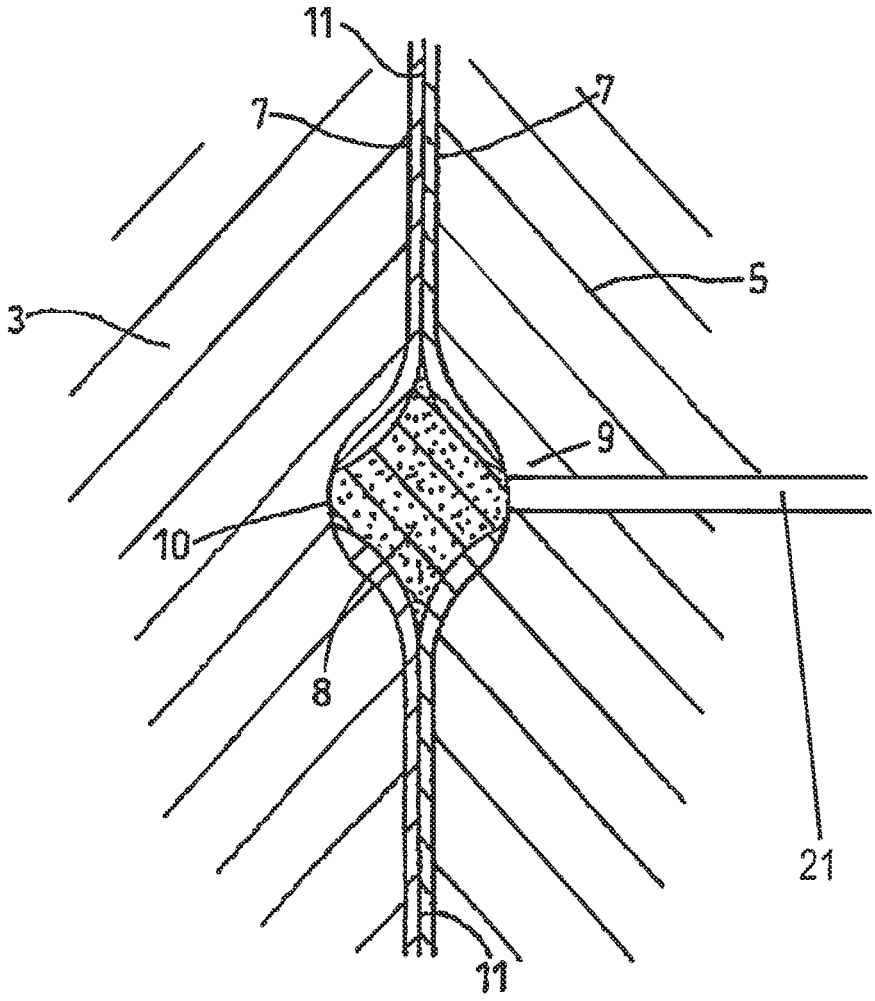
FIG. 8 is similar to FIG. 3, showing the inclusion of a viewing channel.
Figure 9:
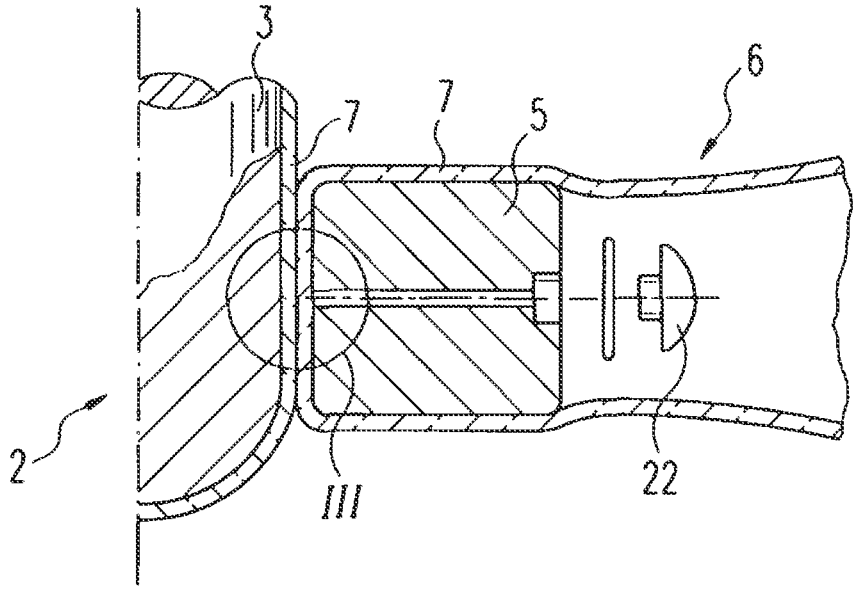
FIG. 9 is similar to FIG. 2, also showing the viewing channel of FIG. 8.

A further possible feature which could be incorporated into the agitator assembly 1 is shown in FIGS. 8 and 9. In this design, the provision of a small channel 21 leading to the pocket of electrically conductive pasty medium 8 is shown. This optional channel 21 could be provided either in the hub 5 of the agitator blade assembly 6, or indeed through the end of the drive shaft 2. Such a channel 21 would advantageously lead from the outside of the agitator assembly 1 through to the two pockets 12 providing the region housing the pasty medium 8.

As is shown in FIG. 9, the channel 21 could pass through the hub 5 of the agitator blade assembly 6 from the region of the blades to the joining region between the hub 5 and drive shaft 2. It would be desirable if such a channel 21 were to be provided, for this to be sealed at the outer end to avoid material surrounding the agitator assembly 1 access to the pasty medium 8. A great many conceivable mechanisms for sealing the end of this channel 21 are obvious, and the example shown in FIG. 9 is the provision of a screw 22. Obviously, a plug type element which is friction fit within the channel 21 is also conceivable if this will provide the appropriate watertight seal blocking the end of the channel 21, rather than having to provide a screw thread and screw element 22.

The channel 21 can be used for a variety of techniques in conjunction with the pockets 12. Firstly, it will be possible to provide a friction fit agitator assembly 1 without dosing the pockets 12 with the pasty medium 8. By means of the channel 21, the pasty medium 8 could be injected through the channel 21 so as to fully fill the two pockets 12. Additionally, the channel 21 could be used in a system where the two pockets 12 had been previously filled, but not completely, so that the entire space formed by these two pockets 12 can be appropriately filled.

Should the channel 21 be provided in addition to the sealing element 20, the channel 21 could be used to ensure that the seal formed by sealing element 20 is in fact complete and water/airtight. By accessing the open end of channel 21, the channel 21 could be pressurized, and it could be monitored whether the region of the two pockets 12 and the seal 20 were appropriately sealed. Obviously, if a full air and watertight seal is provided by the sealing element 20, the channel 21 will remain pressurized and no leak will be detected. Naturally, if a leak is present through channel 21 and the region defined by the two pockets 12 and the seal 20, this will also be detected by means of over pressurizing the channel 21. In this regard, the channel 21 can be considered as an observation port for checking the status of the two pockets 12 and seal element 20.

Further, the channel 21 could be used as a way to remove the pasty medium 8 from the region of the seal between the hub 5 and drive shaft 2. In order to improve the disassembly of the hub 5 and drive shaft 2, for routine maintenance or the like, it is advantageous to remove the pasty medium 8 before this is undertaken. Typically, the pasty medium 8 can freeze before the temperature used for removing the shrink-fit between the hub 5 and drive shaft 2, thus hindering the disassembly process. By use of an appropriate solvent and syringe through the channel 21, the pasty medium 8 can be flushed out of the region defined by the two pockets 12, thus facilitating eventual disassembly. Also, it is possible to use this method to replace the pasty medium 8, by removing the medium through the channel and then replacing with fresh pasty medium 8.

Figure 10:
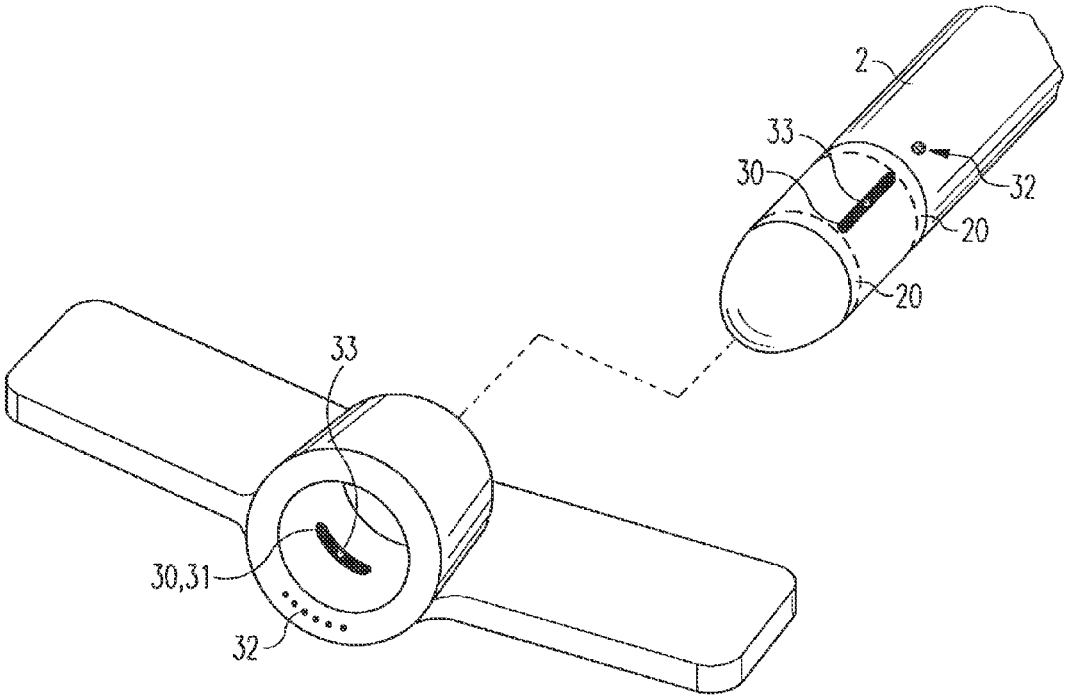
FIG. 10 shows a perspective view of a system in which an extended channel is provided for connection through a non-conductive coating.
Figure 11:
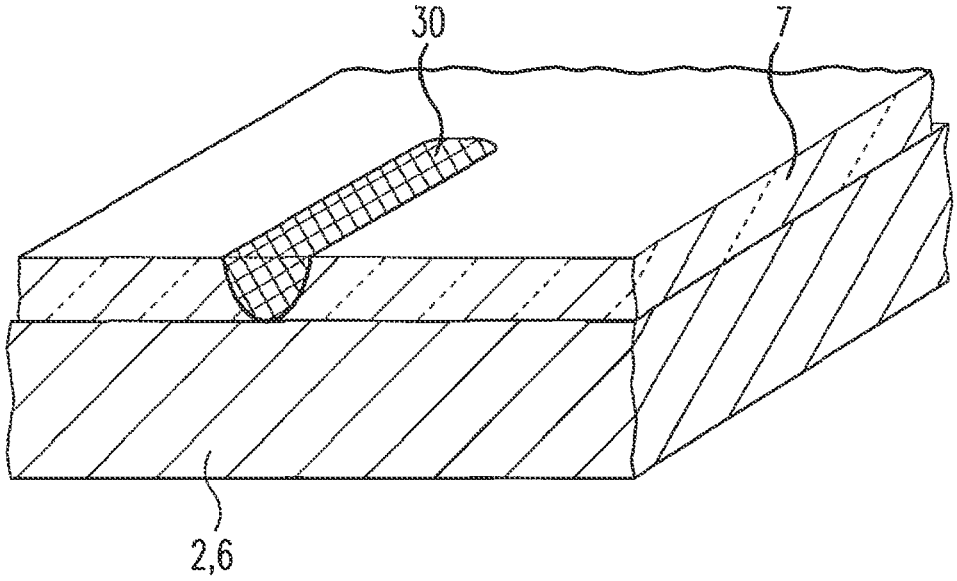
FIG. 11 is a perspective cross-section through one of the grooves shown in FIG. 10.
Figure 12:
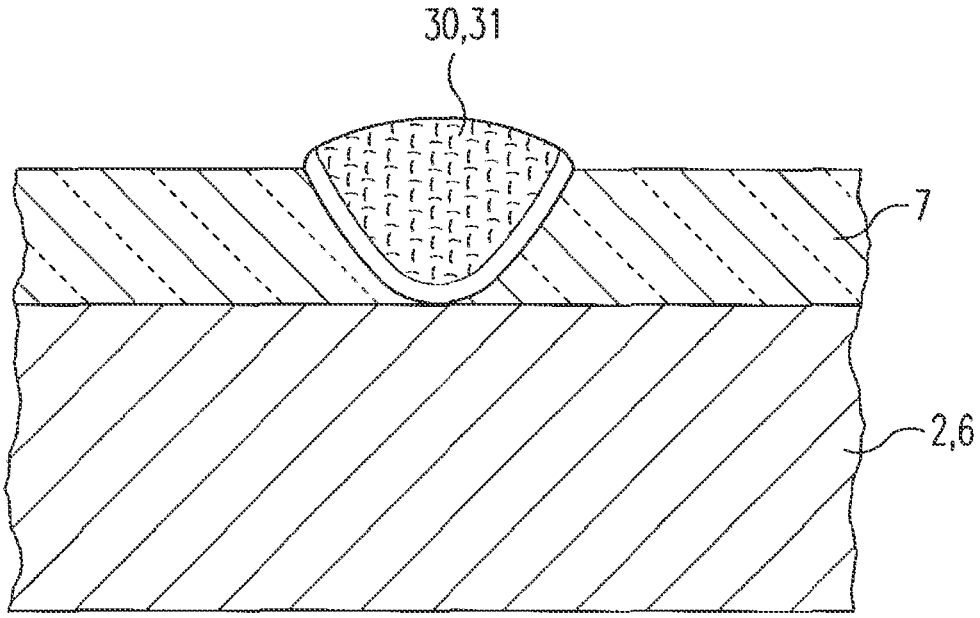
FIG. 12 is a second cross-section through one of the grooves shown in FIG. 10.

Further aspects and options for forming an electrical connection between two or more electrically conductive elements 2, 6, are shown in FIGS. 10-12. Once again, the electrically conductive elements 2, 6 are described and shown as a driveshaft 2 and agitator blade assembly 6. This is again by way of an example, and the general concept and teachings of these figures can be readily extended to any elements which have a non-conductive coating 7 and require an electrical connection between the conductive body parts.

Looking at FIG. 10, many of the aspects relating to the method of forming the connection, and the connection itself, can be seen. These aspects are intended to be in addition to the above disclosed aspects relating to the provision of a seal 20, or a channel 21 leading to the electrical connection point. Further, as the reader will appreciate, the teachings of FIGS. 10-12 may also be operated in isolation from the other aspects described above.

In order to improve the alignment between the electrically conductive elements 2, 6, it is possible to provide a conductive portion which has an extended structure. By providing the conductive portion between the two electrically conductive elements 2, 6 by an extended conductive structure, the requirements of exact alignment between the portions of the non-conductive coating 7 with a break through to the electrically conductive elements 2, 6, can be relaxed. This is most clearly seen in FIG. 10.

One preferred design for the extended conductive regions, is to provide extended grooves 30 passing through the non-conductive coating 7 to the conductive elements 2, 6 underneath. This extended groove 30 can be seen in FIGS. 11 and 12, with FIG. 11 showing a projection view of such. As can be seen, the non-conductive coating 7 is provided on top of the electrically conductive elements 2, 6 and a groove 30 can be formed therein. Any technique of generating the groove 30 can be used, including actually forming the non-conductive coating 7 to create the extended groove 30. Drilling, boring or scraping part of the non-conductive coating 7 off to reveal the conductive surface beneath is also conceivable. It is also possible to not provide an extended groove 30 fully through the non-conductive coating 7, but rather to create a single hole through the non-conductive coating 7 to the electrical material underneath, and then create a groove 30 in the non-conductive coating 7 which extends across the surface of the non-conductive coating 7 but does not penetrate to the electrical surface underneath. In the example shown, the extended groove 30 is an elongate straight groove 30 which is positioned in the region of the electrically conductive element 2, 6 which will be joined together to form the joint. As can be seen in FIG. 10, it is possible to provide a seal 20 around part of the extended channel 30, thus further improving the isolation properties of the resultant electrical connection. For example, the seal 20 could be formed by simply spraying with a PTFE spray, or in any of the other methods described above.

In order to improve the overlap between the extended grooves 30, it is desirable to position the grooves 30 such that when the electrically conductive elements 2, 6 are joined together, the extended grooves 30 do not lie parallel with each other. By forming the grooves 30 such that they will not lie parallel, this improves the range of relative orientations between the electrically conductive elements 2, 6 which can be used to then form the electrical conduction between the two elements 2, 6. The example shown in the FIG. 10 is that of the extended grooves 30 lying virtually perpendicular with respect to each other. Naturally, this is the most desirable orientation between the extended grooves 30, as this allows for the greatest range of possible orientations between the electrically conductive elements 2, 6 which will allow, and still generate, the electrical connection between the two parts.

It is further advisable or desirable for the extended grooves 30 to be formed such that after joining together of the electrically conductive elements 2,6, the central points 33 of each of the extended channels 30 would be in a position that they could overlap. As can be seen in FIG. 10, when the shaft 2 is positioned within the agitator assembly 6, the centre 33 of each of the extended grooves 30 will overlap. By allowing for a mismatch between the fixing together of the electrically conductive elements 2,6 in such a way, the range of relative orientations allowable to form the electrical connection will be improved, as any possible overlap of the extended grooves 30 would lead to an electrical connection between the electrically conductive elements 2, 6. In the example given in FIG. 10, the extended groove 30 on the shaft 2 lies along the axial direction, and the extended groove 30 on the agitator assembly 6 lies in the circumferential direction. When the shaft 2 is appropriately held within the hub 5 of the agitator assembly 6, the centre 33 of each of the extended grooves 30 could potentially overlap, which will allow for the greatest range of alignments between the two elements 2, 6 to still generate the electrical connection. That is, the centre 33 of each groove 30 will lie at the same axial location along the central axis of the shaft 2.

As can be seen in FIG. 12, it is possible to generate the electrically conductive portion in the extended channel 30 by adding a silver paint or paste within the formed groove or channel 30. This silver paint or paste is useful as it reduces the resistance between the electrically conductive elements 2, 6 and the resultant conductive medium 8 to be placed within the extended groove 30. Obviously, other materials which can perform the same task could be used, although silver paint is well known for its low resistance and as a conductive bridging layer in such circumstances.

The conductive material or medium 8 can be provided by a variety of materials, including those discussed above. It is also possible in the present system, as well as the system shown in FIGS. 1-9, to use a conductive pasty medium 8 which can be transformed into an enamel or glass-like structure, similar in physical properties to the non-conductive coating 7, after its deposition. For example, if a mixture of a metal with the enamel material forming the non-conductive coating 7 is used as the conductive pasty medium 8, after a sintering or heat treatment, as is well known in the art and could be done at around 800° C., the conductive pasty medium 8 is transformed into a conductive glass or enamel-type region 31, which has similar physical properties to the non-conductive coating 7 but has a high electrical conductivity. In this way, the conductive glass or enamel-like region 31 forms a well protected electrical contact from the harsh environment in which certain of the systems could be used, but is also useful and provides the required conductive section to allow electrical connection of the parts.

Choice of the metal within the pasty medium 8 is not limited, although the use of rhodium or platinum in a 50:50 enamel mix is preferred. Rhodium and platinum are particularly desirable as they have good electrical conductivity, and also have very low chemical reactivity. The use of these materials will thus mean that if the eventual structure is to be provided in a harsh environment, the conductive glass or enamel-like region 31 will not be damaged or affected by any harsh chemicals or the like. It is further advisable and desirable to pick a metal and enamel mixture which will have similar thermal expansion properties as the non-conductive coating 7, such that the non-conductive coating 7 and the conductive glass or enamel-like region 31 will expand and contract to the same degree, thus meaning that a crack or gap in the coating will not arise in use.

It is particularly interesting and useful to provide the groove 30 in the non-conductive coating 7 and fill this with the above mentioned pasty conductive material 8 in order to create an appropriate connection there-between. After sintering the electrically conductive element 2, 6, the pasty conductive medium 8 is transferred into the glass or enamel-like region 31 which has a high electrical conductivity so that the electrical connection can be made between the electrically conductive elements 2, 6. Upon fitting together of the electrically conductive elements 2, 6, perhaps by means of a shrink fit or friction fit engagement, the alignment between the conductive glass or enamel-like region 31 in each of the extended grooves 30 can be achieved quite readily, as there is a good tolerance between the locations of the extended grooves 30 on each of the electrically conductive elements 2, 6.

It is also possible to provide a series of markings 30 on each of the electrically conductive elements 2, 6 which are to be connected together. By providing a marking or markings 32 on sections of the electrically conductive element 2, 6 which will not be hidden when the electrically conductive elements 2, 6 are joined together, it is possible to improve the connection overlap between the extended grooves 30. As can be seen in FIG. 10, the markings can be provided such that the engineer or technician can see the full extent to which the extended groove 30 extends in certain directions, i.e. a projection is provided in a certain direction showing the extent to which the groove 30 extends in this direction, so that the skilled person, engineer or technician can appreciate that the grooves will be appropriately aligned when the markings 32 are also aligned.

In the example given in FIG. 10, the marking 32 on the agitator assembly 6 is shown extending around the circumference of the hub 5, and the marking 32 on the shaft 2 is shown as a dot as the extension in the circumferential direction is a single point on the shaft 2. The nature of the markings 32 is in no way limited, and is a desirable option to improve the chances of overlapping the conductive regions, whether formed by the conductive glass or enamel-like region 31 or the filled extended grooves 30 with the conductive pastes 8. In this regard, the electrical connection between the electrically conducted elements 2, 6 can be ensured and improved.

The above discussion of the agitator assembly 1 has been presented in relation to the attached figures. In this discussion, however, no intended explicit combination of features should be derivable therefrom. Indeed, it is intended that the above discussion be understood to be a collection of possible features and ideas which can be combined as required by the skilled practitioner. That is, no combination of features should be considered as explicitly defined in combination, and all aspects should be considered as combinable in any possible permutation or combination of features.

What is claimed is:

1. A method of forming an electrically conductive connection between two or more electrically conductive elements (2, 6) which are coated with a non-conductive coating (7), wherein an at least partially electrically conductive pasty medium (8) is located in a region (12) between the electrically conductive elements (2, 6) at regions of the electrically conductive elements (2, 6) which are substantially free from any non-conductive coating (7), wherein one or more sealing elements (20) are positioned such that they completely isolate the partially electrically conductive pasty medium (8), such that after the electrically conductive elements (2, 6) are connected together, the sealing element (20) is held, and preferably compressed, between the electrically conductive elements (2, 6) and form a seal separating the at least partially electrically conductive pasty medium (8) from the surrounding environment.

2. The method according to claim 1, wherein the sealing element (20) is formed as an integral part of one or more of the electrically conductive elements (2, 6), or is a separate part located between the electrically conductive elements (2, 6) at the time the electrically conductive elements (2, 6) are connected together.

3. The method according to claim 1 wherein the two or more electrically conductive elements (2, 6) are shrink fit together, thereby deforming the sealing element (20) between each of the electrically conductive elements (2, 6) and forming the seal.

4. The method according to claim 1 wherein the at least partially electrically conductive pasty medium (8) is held within a pocket (12) provided in at least one of the electrically conductive elements (2, 6) and the sealing element (20) is integral to the electrically conductive element (2, 6) and positioned completely around the at least partially electrically conductive pasty medium (8) thus forming an enclosing seal after the electrically conductive elements (2, 6) are brought into contact.

5. The method according to claim 1 wherein the at least partially electrically conductive pasty medium (8) is held within a pocket (12) provided in at least one of the electrically conductive elements (2, 6) and at least one sealing element (20) is provided between the electrically conductive elements (2, 6) such that upon connecting together the electrically conductive elements (2, 6) the sealing elements (20) are located between the at least partially electrically conductive pasty medium (8) and the surrounding environment to create seals which separate and isolate the at least partially electrically conductive pasty medium (8) from the surrounding environment.

6. The method according claim 1 wherein one or more channels (21) are formed in one or more of the electrically conductive elements (2, 6) from the outside of the electrically conductive element (2, 6) leading to the at least partially electrically conductive pasty medium (8) so as to allow for observation of the at least partially electrically conductive pasty medium (8), removal of the at least partially electrically conductive pasty medium (8) and addition of further at least partially electrically conductive pasty medium (8).

7. The method according to claim 6, wherein the one or more channels (21) are sealable at the end not adjacent the at least partially electrically conductive pasty medium (8) by means of a screw or plug element (22).

8. A method according to claim 1 wherein the non-conductive coating (7) on the first of the electrically conductive elements (2) is ground or cut or produced so as to provide a first extended groove (30) which passes through the non-conductive coating (7) to the first electrically conductive element (2), and the non-conductive coating (7) on the second of the electrically conductive elements (6) is ground or cut or produced so as to provide a second extended groove (30) which passes through the non-conductive coating (7) to the second electrically conductive element (6), wherein further the first and second extended grooves (30) are provided on the first and second electrically conductive elements (2, 6) such that when the first and second electrically conductive elements (2, 6) are joined together, the first and second extended grooves (30) lie at an angle other than parallel with respect to each other, the method further comprising: filling each of the first and second extended grooves (30) with a conductive medium (8), and joining together the first and second electrically conductive elements (2, 6) such that the first and second extended grooves (30) overlap and form an electrical connection via the conductive medium (8) between the first and second electrically conductive elements (2, 6).

9. The method according to claim 8, wherein the conductive medium (8) is a mixture between a metal and the enamel making up the non-conductive coating (7), preferably around a 50:50 mixture, and that the method further comprises: heating the first and second electrically conductive elements (2, 6) after filling of the first and second extended grooves (30), so that the conductive medium sinters and produces a conductive glass- or enamel-like region (31) having similar physical properties to the non-conductive coating (7).

10. The method according to claim 9 wherein the extended grooves (30) are elongate straight line grooves and the angle between the first and second extended grooves (30), after the first and second electrically conductive elements (2, 6) have been connected together, is 90°±10°.

11. The method according to claim 9 wherein the extended grooves (30) are formed on each of the electrically conductive elements (2, 6) at locations such that after the connection together of the electrically conductive elements (2, 6), the centers (33) of the extended grooves (30) would all overlap if the electrically conductive elements (2, 6) were all perfectly aligned.

12. The method according to claim 9 wherein the method further comprises: placing a marking (32) on each of the electrically conductive elements (2, 6) in a region of the electrically conductive element (2, 6) which will not be hidden when the electrically conductive elements (2, 6) are connected together, the marking (32) showing an indication of the location of, as well as an indication of the extent or size of, the extended groove (30), such that the relative locations and overlap of the extended grooves (30) on each of the electrically conductive elements (2, 6) can be determined when fixing together the two or more electrically conductive elements (2, 6).

13. An electrically conductive connection according to claim 11 between two or more electrically conductive elements (2, 6) which are coated with a non-conductive coating (7), wherein the non-conductive coating (7) on the first of the electrically conductive elements (2) is provided as a first extended groove (30) which passes through the non-conductive coating (7) to the first electrically conductive element (2), and the non-conductive coating (7) on the second of the electrically conductive elements (6) is provided with a second extended groove (30) which passes through the non-conductive coating (7) to the second electrically conductive element (6), wherein further the first and second extended grooves (30) are provided on the first and second electrically conductive elements (2, 6) such that when the first and second electrically conductive elements (2, 6) are joined together, the first and second extended grooves (30) lie at an angle other than parallel with respect to each other, and wherein each of the first and second extended grooves (30) is filled with a conductive medium (8), and the first and second extended grooves (30) overlap and form an electrical connection via the conductive medium (8) between the first and second electrically conductive elements (2, 6).

14. The electrically conductive connection according to claim 13, wherein the conductive medium (8) is a mixture between a metal and the enamel making up the non-conductive coating (7) and that the conductive medium has been sintered and is a conductive glass- or enamel-like region (31) having similar physical properties to the non-conductive coating (7).

15. The electrically conductive connection according to claim 14, wherein the extended grooves (30) are elongate straight line grooves and the angle between the first and second extended grooves (30), after the first and second electrically conductive elements (2, 6) have been connected together, is 90°±10°.

16. The electrically conductive connection according to claim 14 wherein the extended grooves (30) are formed on each of the electrically conductive elements (2, 6) at locations such that after the connection together of the electrically conductive elements (2, 6), the centers (33) of the extended grooves (30) would all overlap if the electrically conductive elements (2, 6) were all perfectly aligned.

17. The electrically conductive connection according to claim 14, wherein each of the electrically conductive elements (2, 6) comprises a marking (32) in a region which will not be hidden when the electrically conductive elements (2, 6) are connected together, the marking (32) showing an indication of the location of, as well as an indication of the extent or size of, the extended groove (30), such that the relative locations and overlap of the extended grooves (30) on each of the electrically conductive elements (2, 6) can be determined when fixing together the two or more electrically conductive elements (2, 6).

18. An electrically conductive connection between two or more electrically conductive elements (2, 6) which are coated with a non-conductive coating (7), wherein an at least partially electrically conductive pasty medium (8) is located in a region (12) between the electrically conductive elements (2, 6) at regions of the electrically conductive elements (2, 6) which are substantially free from any non-conductive coating (7), characterized by: further comprising one or more sealing elements (20) positioned such that they completely isolate the partially electrically conductive pasty medium (8), such that after the electrically conductive elements (2, 6) are connected together, the sealing element (20) is held, and preferably compressed, between the electrically conductive elements (2, 6) and forms seal separating the at least partially electrically conductive pasty medium (8) from the surrounding environment.

19. The electrically conductive connection according to claim 18, wherein the sealing element (20) is an integral part of one or more of the electrically conductive elements (2, 6), or is a separate part located between the electrically conductive elements (2, 6).

20. An electrically conductive connection according to claim 18 between one or more electrically conductive elements (2, 6) which are coated with a non-conductive coating (7), wherein an at least partially electrically conductive pasty medium (8) is to be, or already is, located in a region (12) between the electrically conductive elements (2, 6) at regions of the electrically conductive elements (2, 6) which are substantially free from any non-conductive coating (7), wherein one or more channels (21) are provided from the outside of one or other of the electrically conductive elements (2, 6) to the regions of the electrically conductive elements (2, 6) which are substantially free from any non- conductive coating (7).

21. A method of forming, removing and checking upon an electrically conductive connection between one or more electrically conductive elements (2, 6) which are coated with a non-conductive coating (7), wherein an at least partially electrically conductive pasty medium (8) is to be, or already is, located in a region (12) between the electrically conductive elements (2, 6) at regions of the electrically conductive elements (2, 6) which are substantially free from any non-conductive coating (7), characterized by: providing one or more channels (21) from the outside of one or other of the electrically conductive elements (2, 6) to the regions of the electrically conductive elements (2, 6) which are substantially free from any non-conductive coating (7) and either:

a) injecting the at least partially electrically conductive pasty medium (8) through the one or more channels (21) to the regions of the electrically conductive elements (2, 6) which are substantially free from any non- conductive coating (7); or b) injecting an appropriate solvent through the one or more channels (21) to the at least partially electrically conductive pasty medium (8) in order to dissolve the at least partially electrically conductive pasty medium (8) and allow this to be flushed out of connection; or c) looking through the one or more channels (21) in order to ensure that enough of the at least partially electrically conductive pasty medium (8) is present in the connection to form an appropriate electrical connection; or d) injecting pressurized fluid through the one or more channels (21) to gauge whether the region holding the at least partially electrically conductive pasty medium (8) are isolated and air and/or watertight.

* * * * *